US012546096B2

(12) United States Patent
Melkonian et al.

(10) Patent No.: US 12,546,096 B2
(45) Date of Patent: Feb. 10, 2026

(54) WATER DISPENSER RISER ASSEMBLY AND SYSTEM

(71) Applicant: Brio Water Technology, Inc., City of Industry, CA (US)

(72) Inventors: Arman Melkonian, La Cañada Flintridge, CA (US); Mark Melkonian, Northridge, CA (US); Ryan Nguyen, Westminster, CA (US)

(73) Assignee: Brio Water Technology, Inc., City of Industry, CA (US)

( * ) Notice: Subject to any disclaimer, the term of this patent is extended or adjusted under 35 U.S.C. 154(b) by 0 days.

(21) Appl. No.: 19/089,625

(22) Filed: Mar. 25, 2025

(65) Prior Publication Data

US 2025/0305258 A1 Oct. 2, 2025

Related U.S. Application Data

(60) Provisional application No. 63/571,411, filed on Mar. 28, 2024.

(51) Int. Cl.
*E03B 9/20* (2006.01)

(52) U.S. Cl.
CPC ..... *E03B 9/20* (2013.01)

(58) Field of Classification Search
CPC ..... E03B 9/20; F16M 2200/08
USPC ..... 248/346.01, 346.03, 346.06
See application file for complete search history.

(56) References Cited

U.S. PATENT DOCUMENTS 3,493,201 A * 2/1970 Marran ..... H01H 1/60 411/116
4,936,117 A * 6/1990 Kabeya ..... D06F 39/12 68/3 R
5,685,441 A * 11/1997 Calfee ..... A47B 81/06 211/188
5,956,835 A * 9/1999 Aksu ..... G01R 1/07328 29/559
6,007,038 A * 12/1999 Han ..... F16M 11/2014 248/346.06
6,216,994 B1 * 4/2001 Yeh ..... F16M 11/42 248/346.06
6,219,981 B1 * 4/2001 Bergelt ..... E02D 27/01 52/294
6,427,966 B1 * 8/2002 Blumenschein ..... A47B 91/005 248/646
6,634,612 B1 * 10/2003 Shin ..... H04N 1/1004 313/407
6,655,648 B2 * 12/2003 Harris ..... E02D 27/14 248/156

(Continued)

*Primary Examiner* — Muhammad Ijaz
(74) *Attorney, Agent, or Firm* — Foundation Law Group LLP

(57) ABSTRACT

A reconfigurable water dispenser riser assembly to elevate a water dispenser. The water dispenser riser assembly has multiple components that can be reconfigured and arranged to match a specific water dispenser. The water dispenser riser assembly includes an interchangeable, uniform core component that differing top plates and front plates can be attached and secured to. The top plate of the riser can be switched out, as needed, to match, attach and secure to a specific base of a specific water dispenser. The front plate of the assembly can also be chosen to match the aesthetic, shape and size of a specific water dispenser.

5 Claims, 9 Drawing Sheets

(56) References Cited

U.S. PATENT DOCUMENTS 6,755,384 B2 * 6/2004 Gorfain ..... G01N 35/0099 248/618
6,923,419 B2 * 8/2005 George ..... F25D 23/00 248/676
7,168,261 B2 * 1/2007 Grewal ..... B67D 1/0864 62/340
7,334,421 B1 * 2/2008 Cantolino ..... F24F 13/32 62/298
7,748,682 B2 * 7/2010 Hunke ..... F16M 7/00 248/673
7,780,140 B1 * 8/2010 Ward ..... E02D 27/44 248/678
7,810,782 B1 * 10/2010 Driscoll ..... D06F 39/125 248/676
7,921,679 B2 * 4/2011 Jo ..... D06F 39/125 68/3 R
7,980,523 B2 * 7/2011 O'Neil ..... F16M 11/22 108/42
8,113,603 B2 * 2/2012 Park ..... D06F 39/12 312/228
8,757,575 B2 * 6/2014 Lin ..... H05K 7/142 411/389
8,851,438 B2 * 10/2014 Marshall ..... B23Q 11/0032 248/346.02
9,499,933 B2 * 11/2016 Deryckere ..... F16M 13/00
10,559,742 B1 * 2/2020 Sting ..... H10F 71/00
11,649,921 B1 * 5/2023 Carpenter ..... F16M 11/22 248/346.03
11,668,432 B1 * 6/2023 Ledesma ..... F16M 5/00 248/346.01
11,745,917 B2 * 9/2023 Chen ..... B65D 19/0012 108/57.12
11,761,226 B2 * 9/2023 Curtis ..... E01F 9/629 248/346.03
11,766,144 B2 * 9/2023 Kraus ..... A47G 23/0225 248/346.03
D1,045,523 S * 10/2024 Melkonian ..... D6/349
D1,049,735 S * 11/2024 Melkonian ..... D7/388
D1,049,736 S * 11/2024 Melkonian ..... D7/388
D1,049,737 S * 11/2024 Melkonian ..... D7/388
D1,058,281 S * 1/2025 Melkonian ..... D7/397
2003/0201375 A1 * 10/2003 Coleman ..... B65D 19/0002 248/346.06
2005/0241344 A1 * 11/2005 Graute ..... D06F 39/12 68/3 R
2008/0236455 A1 * 10/2008 Naidu ..... B65D 19/0038 24/453
2010/0201236 A1 * 8/2010 Kim ..... D06F 39/125 312/228
2011/0284711 A1 * 11/2011 Hsiao ..... H05K 7/1485 248/346.03
2012/0067801 A1 * 3/2012 Bernet ..... F16M 11/24 29/428
2013/0009030 A1 * 1/2013 Ruiz ..... A47C 19/024 248/346.5
2014/0291464 A1 * 10/2014 Palazon Martinez ..... E04H 12/2269 248/346.03
2016/0121774 A1 * 5/2016 Garbarino ..... B60N 3/044 248/346.03
2017/0189783 A1 * 7/2017 Woodrow ..... F16M 11/046
2021/0215291 A1 * 7/2021 Dow ..... F16M 11/22
2022/0048751 A1 * 2/2022 Morris ..... B67D 1/0014

* cited by examiner

WATER DISPENSER RISER ASSEMBLY AND SYSTEM

PRIORITY DATA

This application claims priority from the following U.S. patent application: U.S. Provisional Application Ser. No. 63/571,411, filed on Mar. 28, 2024. The disclosure of such application is incorporated herein, by reference, in its entirety.

BACKGROUND

There are many types of water dispensers such as top-load, bottom-load, and Point-of-Use (POU) dispensers. No matter what type they are, most water dispensers are typically within a particular height range, and this typical height range is not the ideal for a dispenser user. The reason for the height restriction on water dispensers is due mainly to shipping constraints and logistics.

A typical shipping container's internal height is about 93 inches. So, the ideal height of a water dispenser shipping box, for shipping purposes, should maximize use of the shipping container space while allowing the tallest water dispenser box height possible. To put a single layer of water dispenser boxes in a shipping container would waste space. Therefore, the best way to optimize use of the vertical space in a shipping container is to divide the 93 inch height into two, which is 46.5 inches. Having water dispenser shipping boxes at 46.5 inches each allows for two dispensers to fit in the shipping container's approximately 93 inch vertical height. In addition to this overall box height restriction, additional factors make the actual water dispenser in the box even shorter. For instance, a box is needed to encase the water dispenser to provide protection and to provide space for graphical information and labels. Also, water dispensers are shipped and transported with padding material inside the box to reduce damage to the dispenser during shipment. The box and the padding material thickness around the water dispenser take up some of the 46.5 inch vertical height space available, decreasing the ultimate height that the water dispenser can be designed for if it is to be shipped economically.

Unfortunately, the ideal height for shipping a water dispenser is not the ideal height for a user to dispense water at. Most water dispensers are below the ideal water dispensing height. The ideal water dispensing height is slightly below the chest level of an average dispenser user. At this ideal height, the water dispenser nozzle is typically several inches above the glass or cup.

While there are tall water dispensers on the market, they are usually specialty machines for commercial or institutional applications. Residential water coolers are usually shorter to maximize shipping container space, as explained above, and to save space on retail store shelves.

To get the water dispenser to an ideal usable height, external water dispenser stands, platforms or risers can be placed underneath the dispenser. For stability, the base of the riser (where the platform touches the floor) needs to be wider than the width of the water dispenser. The taller the riser; the wider the platform base needs to be. There are two major types of existing water dispenser risers being used: a universal one and a dispenser specific one. Each has its own pros and cons. The universal one can work with most water dispensers; it is cheaper to produce in the long run than a dispenser specific riser and it is far easier to store and keep track of inventory. The downside is that a universal riser does not specifically match any dispensers, and the attachment brackets needed to secure the riser to the water dispenser affect the aesthetic of the combined water dispenser and riser assembly and potentially compromise the functionality of the assembly.

The riser designed specifically for a specific water dispenser is not much better either. Granted, the dispenser specific riser will be aesthetically pleasing because the riser and water dispenser look like it is one cohesive unit; the mounting brackets are hidden; and the unit will be a lot more secure because the holes and cutouts on the top of the specific riser will match and align with the cutouts and base of the water dispenser. However, risers designed for specific water dispensers have a very significant drawback. They can only work with one model of a water dispenser (i.e. the specific water dispenser they were designed for). The riser cannot work with any other water dispenser, and making a dispenser specific riser for each model of a water dispenser would be costly since a riser mold would be needed for each dispenser specific riser and riser molds are expensive because they are relatively large molds to manufacture.

Accordingly, there is a need for a universal water dispenser riser that can be used across multiple water dispenser models while being aesthetically pleasing and not compromising the functionality of the water dispenser and riser assembly.

SUMMARY

According to one aspect of the present invention, a water dispenser riser assembly for use with a water dispenser having a dispensing nozzle, may include a core; a top plate, configured to attach to a base of the water dispenser, connected to the core; and a front plate connected to the core. The top plates may include cutouts and attachment points to match the base of the water dispenser. Further, the front plate may include cutouts and attachment points to match the water dispenser. The connected core and front plate may equal the length of the water dispenser, and the core may be 12 inches in width. According to another aspect of the present invention, when a water dispenser riser assembly of the present invention is connected to the water dispenser, the height of the dispensing nozzle may be approximately slightly below the chest level of an average user.

According to another aspect of the present invention, a water dispenser riser assembly for use with a water dispenser having a dispensing nozzle, may include a core; a top plate configured to attach to the core and a base of the water dispenser; and a front plate configured to attach to the core.

According to yet another aspect of the present invention, a water dispenser riser assembly system for use with a plurality of different water dispensers, may include a standard core; a plurality of top plates that are each designed to match one of the plurality of different water dispensers; a plurality of front plates that are each designed to match one of the plurality of different water dispensers, where the standard core is interchangeable between the plurality of top plates and the plurality of front plates; where a water dispenser is selected from the plurality of different water dispensers; where a top plate and a front plate are selected that are designed to match the selected water dispenser; and where the selected top plate and the selected front plate are attached to the standard core to configure a riser assembly specific for attachment to the selected water dispenser.

DRAWINGS

Objects, features, and advantages of the present invention will become apparent upon reading the following description in conjunction with the drawing figures, in which.

DESCRIPTION

Figure 1:
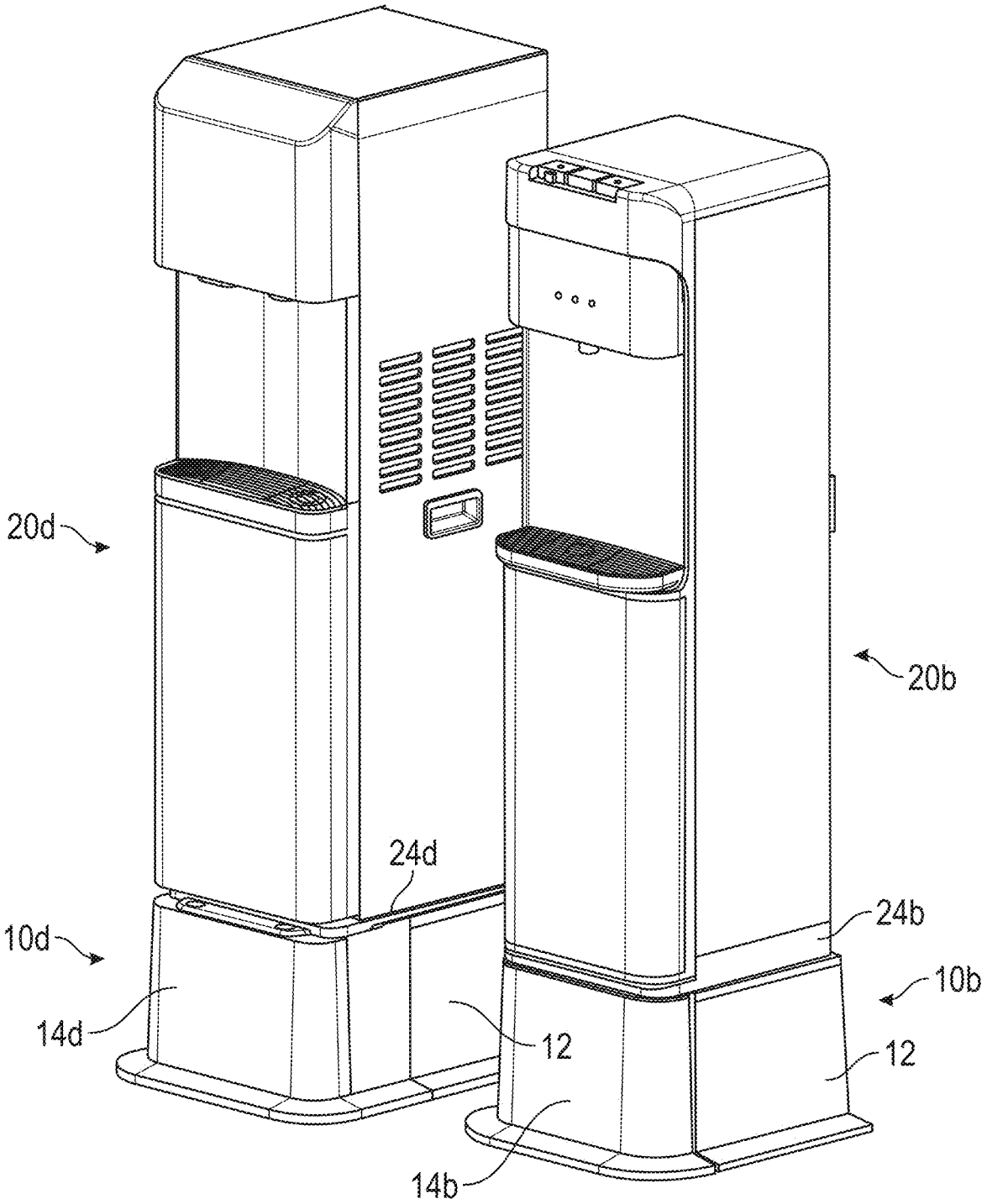
FIG. 1 is a front, top perspective view, showing an embodiment of two riser assemblies of the present invention attached to two different water dispensers.
Figure 2:
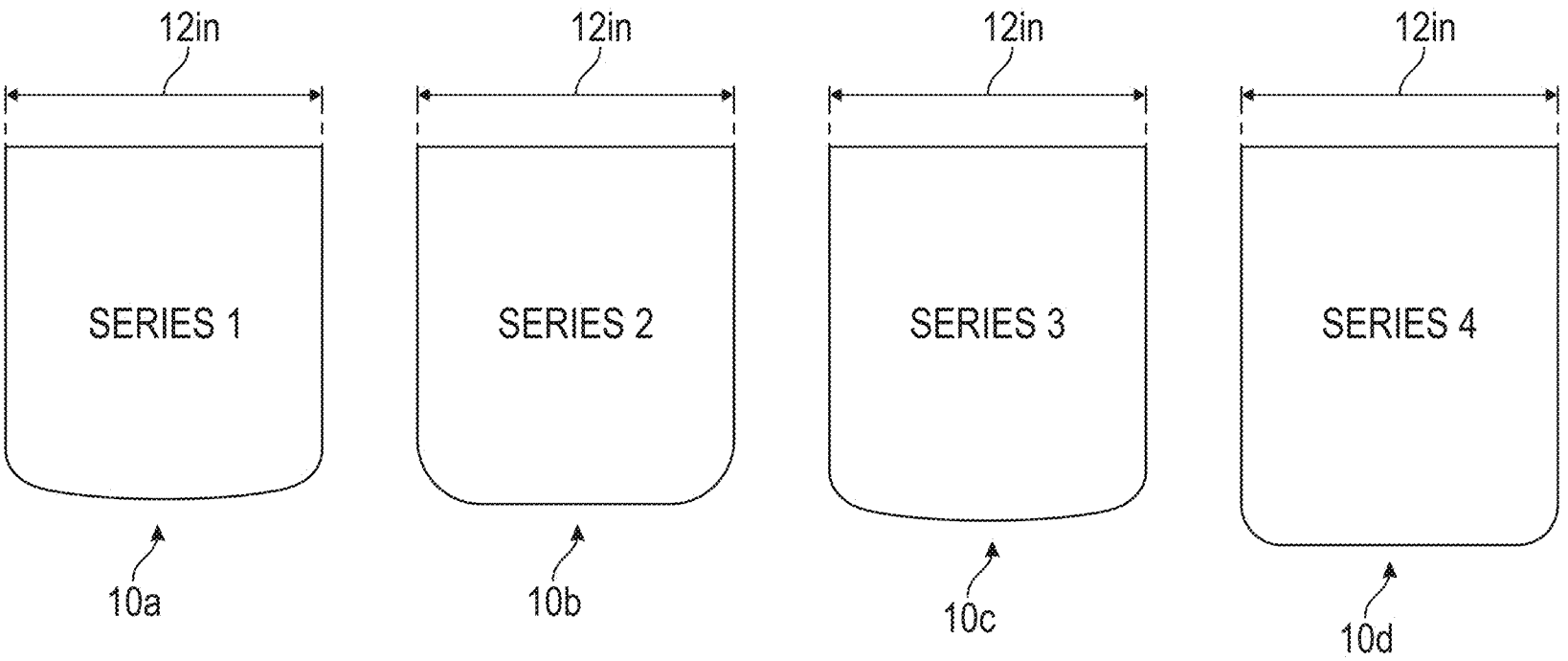
FIG. 2 is a plan view representation of size and shapes of different embodiments of riser assemblies of the present invention.
Figure 3:
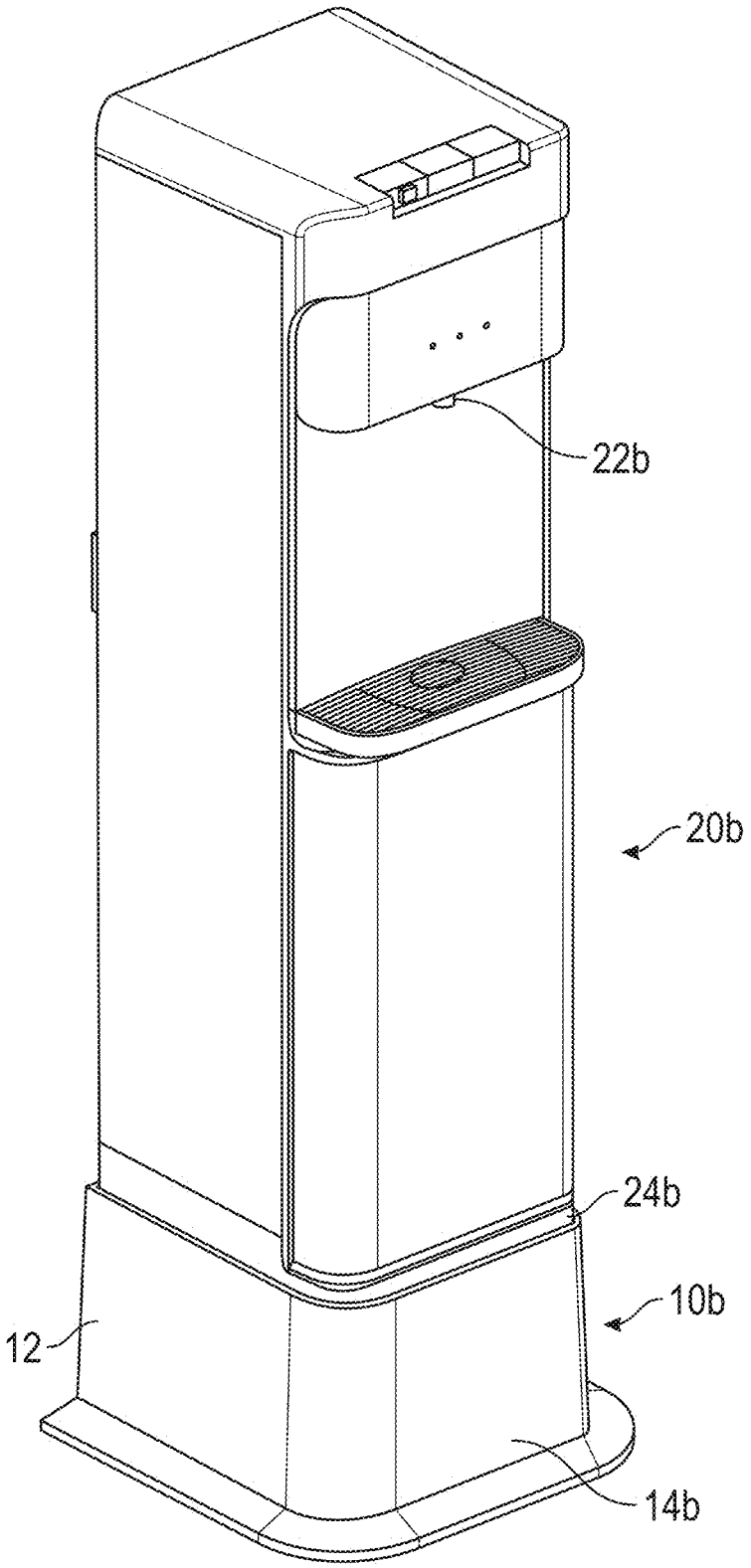
FIG. 3 is a front, top perspective view, showing an embodiment of a riser assembly of the present invention attached to a water dispenser.

Referring to FIG. 1, a riser assembly 10 of the present invention can be connected to a water dispenser 20 to give the water dispenser 20 additional height to put a water dispensing nozzle 22 of the water dispenser 20 at a height that is more ideal for a dispenser user. Typically, the ideal water dispensing height, in other words the point where the water exits the dispensing nozzle 22, is slightly below the chest level of an average dispenser user. The riser assembly 10 of the present invention can be used in combination with any number of water dispensers 20. As depicted in FIG. 1, the riser assemblies 10*b*, 10*d* are shown being used with water dispensers 20*b*, 20*d*. (The components of the riser assemblies 10 and the water dispensers 20 are shown with different letter designations (e.g. a, b, c, d, etc.) for different water dispensers 20 and different configurations of a riser assembly 10.) As depicted in FIG. 2, in one embodiment, the riser assembly 10 can be used with, and re-configured for, an entire series of water dispensers 20*a*-20*d* in a company's product line, if needed. This allows the company to provide a number of different water dispenser options, at heights that the dispenser users desire, while keeping the costs of manufacturing and shipping down for such combinations of riser assemblies 10 and water dispensers 20. In the embodiment depicted in FIG. 2, the riser assemblies 20*a*-20*d* all of have a 12 inch width. It should be understood that this width can be varied as needed.

Figure 6A:
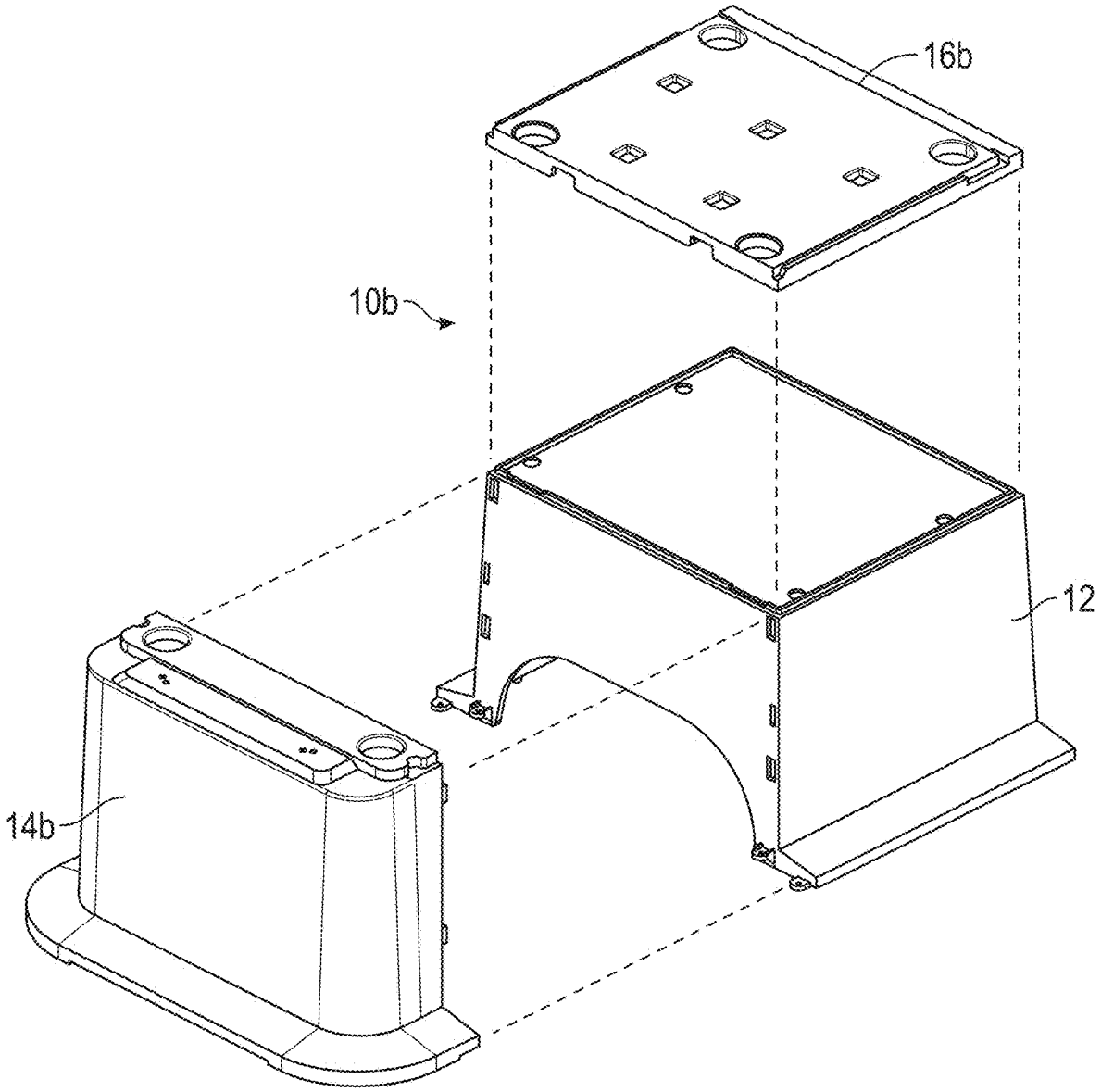
FIG. 6A is an exploded assembly view of the embodiment of the riser assembly depicted in FIG. 5.
Figure 7:
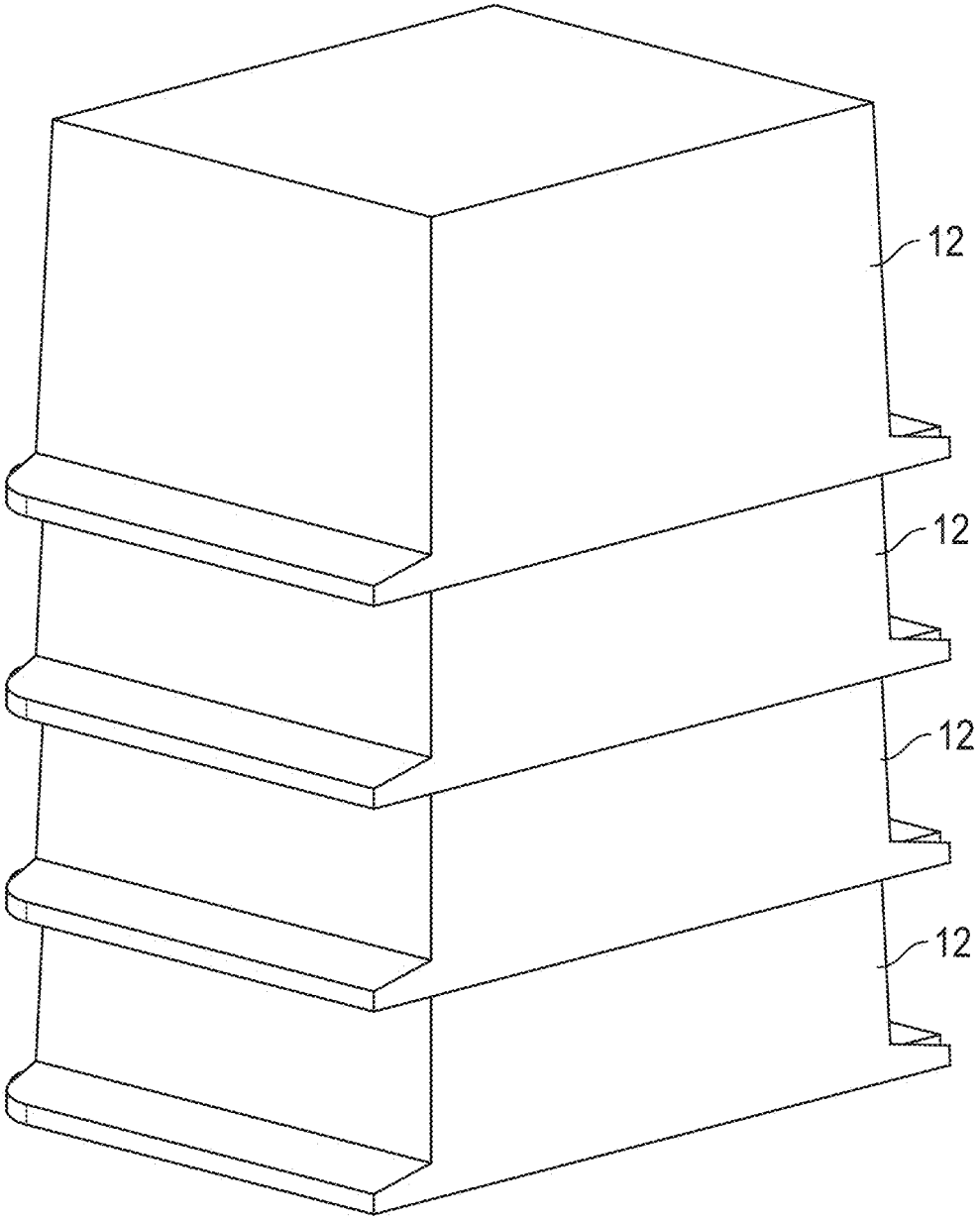
FIG. 7 illustrates several cores of an embodiment of the riser assembly of the present invention stacked on top of one another.

Referring specifically to FIG. 6A, in an embodiment of the present invention, the riser assembly 10*b* has three components: a core 12, which is the main body; a front plate 14*b* and a top plate 16*b*. The core 12 is the largest molded component of the riser assembly 10. The core 12 provides the advantage that it is consistent in design, shape and structure across all water dispensers 20 that a riser assembly 10 can be attached to. The core 12 is the one component of the riser assembly 10 that does not change; no matter what the configuration of the riser assembly 10 is. The top plate 16*b* and the front plate 14*b* are the components that are designed and manufactured to match a specific water dispenser 20*b*. These water dispenser specific components (i.e. front plate 14 and top plate 16) are connected to the interchangeable, uniform core 12, as needed. By having an interchangeable, uniform core 12, this keeps manufacturing costs down, as well as saving space in inventory. Since the cores 12 are uniform, in storage or transport, a number of cores 12 can all be stacked on top of one another (FIG. 7).

Figure 4:
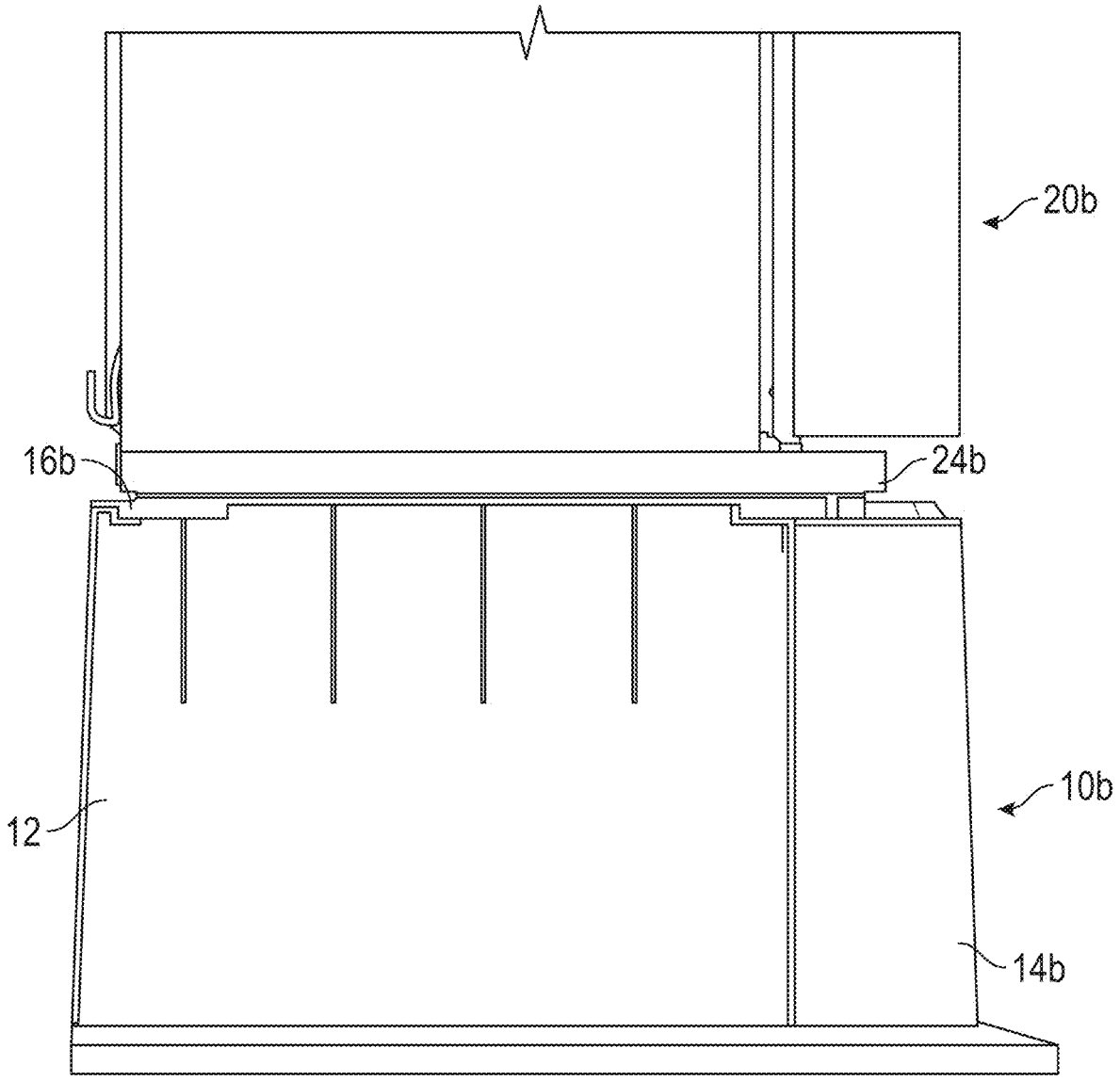
FIG. 4 is a side, partial view depicting an embodiment of a riser assembly of the present invention attached to a water dispenser.
Figure 5:
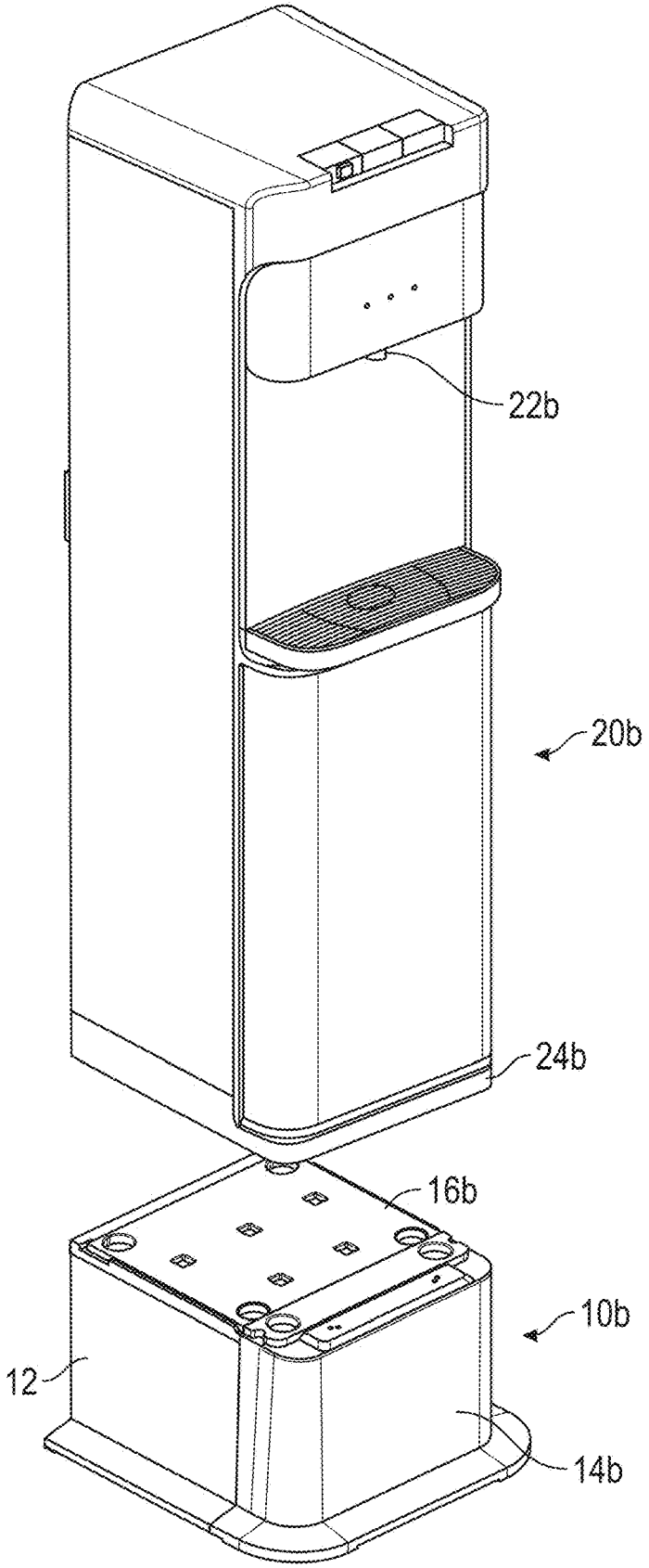
FIG. 5 is an assembly view of an embodiment of a riser assembly of the present invention and a corresponding water dispenser.

The top plate 16 is a smaller molded component that attaches and secures to the core 12 on a top surface when assembled. The top plate 16 can be attached to the core 12 in any known manner, such as by screws; snap engagements or any other method. Further, the top plate 16 has cutouts and attachment points for the specific water dispenser 20 to which it is to be attached. When assembled, the top plate 16 attaches to a base 24 of the water dispenser 20 (FIG. 4). The front plate 14 is a smaller component that attaches to, and secures to, the core 12 along the front surface of the core 12. The front plate 14 can vary in shape and size to aesthetically match the shape and size of the front of the water dispenser 20 it is to be used with. The front plate 14 may also have cutouts and attachment points for the specific water dispenser 20 to which it is to be attached. As with the top plate 16, the front plate 14 can be attached to the core 12 in any known manner, such as by screws; snap engagements or any other method.

Referring to FIGS. 1-6B and 8A-8B, the riser assembly 20 is depicted in use in different configurations with different water dispensers 20*a*-20*d*. Referring specifically to FIG. 1, water dispenser 20*b* is shown in use with riser assembly 10*b*, and water dispenser 20*d* is shown in use with riser assembly 10*d*. The core 12 of the riser assemblies 10*b*, 10*d* are exactly the same. As depicted in FIGS. 6A-6B and 8A-8B, the top plates 16*b*, 16*d* and the front plates 14*b*, 14*d* are what are changed.

Figure 6B:
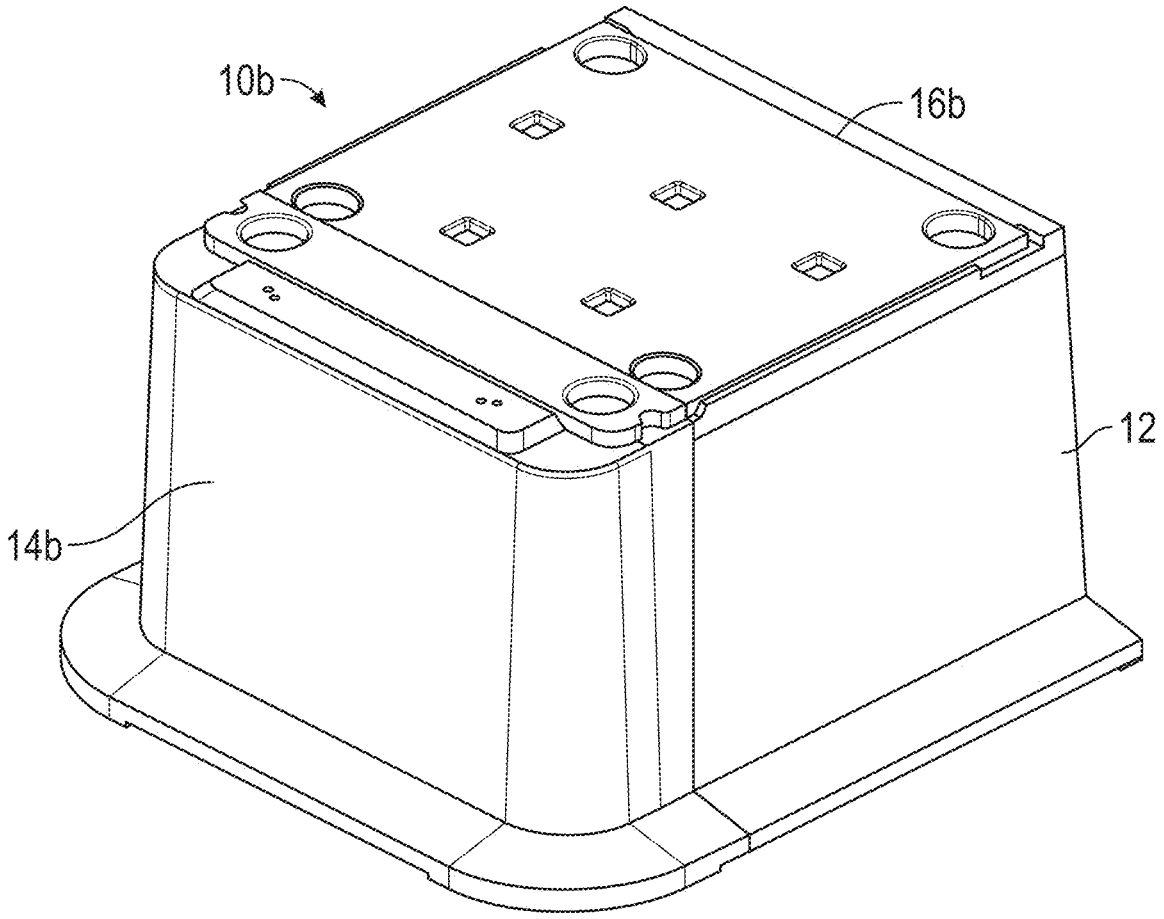
FIG. 6B depicts an assembled view of the embodiment of the riser assembly of depicted in FIG. 6A.

For a first water dispenser 20*b* depicted in FIG. 1 and FIGS. 3-6B, the front plate 14*b* and the top plate 16*b* are attached to a core 12 to make a riser assembly 10*b* as depicted in FIGS. 6A-6B. As depicted in FIG. 4, the top plate 16*b* has cutouts and attachment points (FIG. 6A) that are used to securely attach the base 24*b* of the water dispenser 20*b* to the riser assembly 10*b*. The front plate 14*b* is chosen to match the shape and aesthetic of water dispenser 20*b*, including having cutouts and attachment points that match water dispenser 20*b*.

Figure 8A:
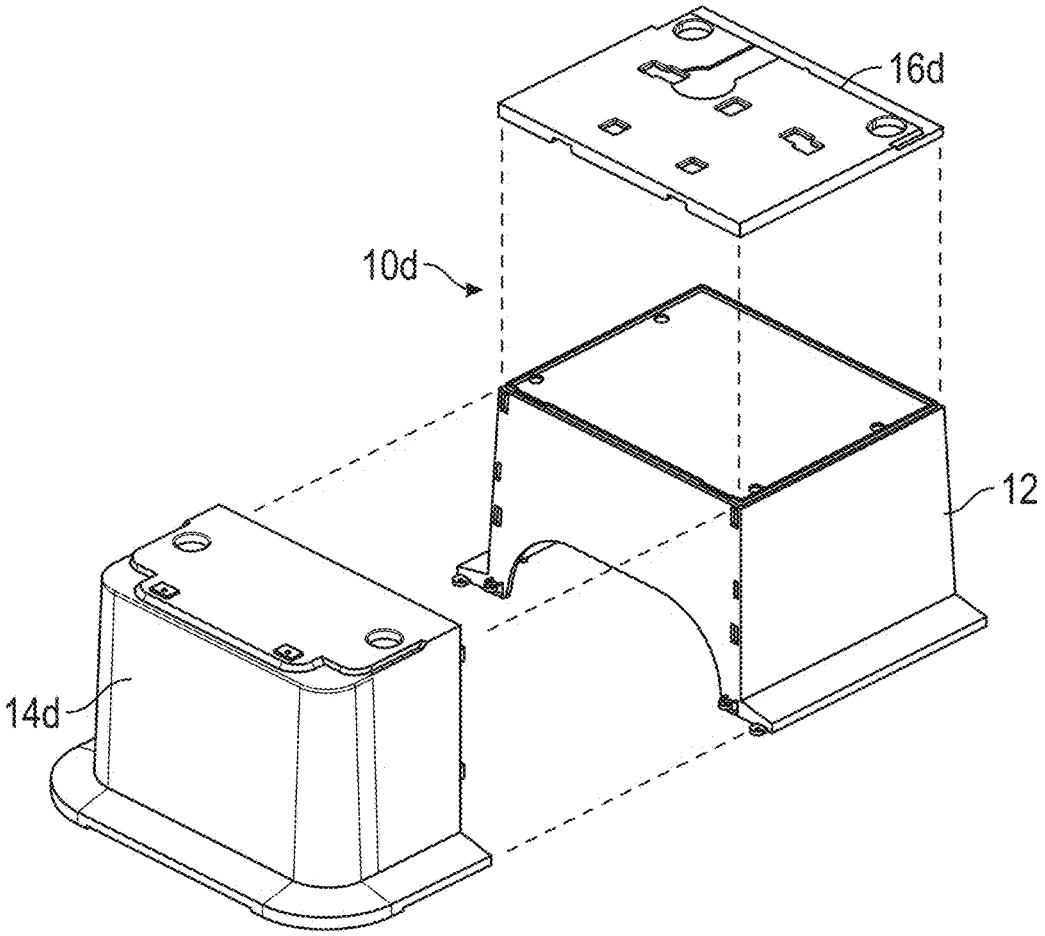
FIG. 8A is an exploded assembly view of another embodiment of the riser assembly depicted of the present invention.
Figure 8B:
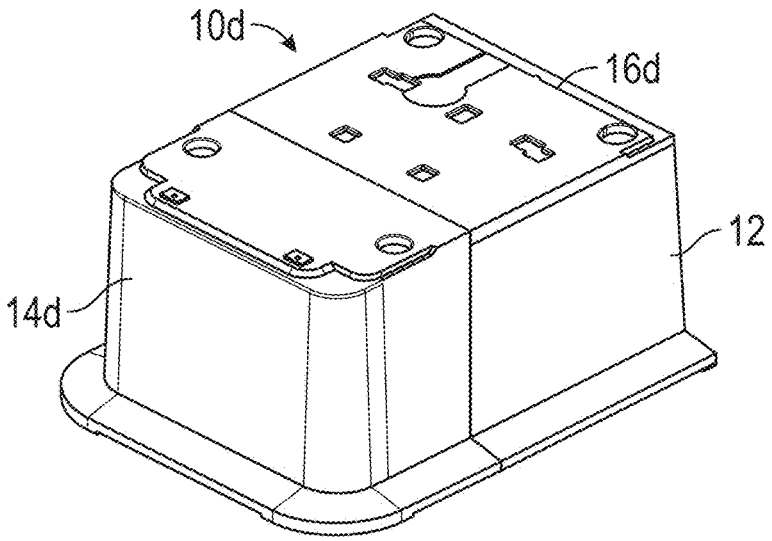
FIG. 8B depicts an assembled view of the embodiment of the riser assembly of depicted in FIG. 8A.

For the second water dispenser 20*d* depicted in FIG. 1 and FIGS. 8A-8B, the front plate 14*d* and the top plate 16*d* are attached to a core 12, in the same way as described above for riser assembly 10*b*, to make a riser assembly 10*d* as depicted in FIGS. 8A-8B. As with the riser assembly 10*b* described above, the top plate 16*d* has cutouts and attachment points (FIG. 8A) that are used to securely attach the base 24*d* (FIG. 1) of the water dispenser 20*d* to the riser assembly 10*d*. The front plate 14*d* is chosen to match the shape and aesthetic of water dispenser 20*d* and, specifically, as illustrated in FIGS. 6A-6B and 8A-8B, since the water dispenser 20*d* has a longer back to front profile than the water dispenser 20*b*, the front plate 14*d* is longer than the front plate 14*b* to accommodate the extra needed length of water dispenser 20*d* while still using a standard core 12.

Although certain embodiments and features of a water dispenser riser assembly have been described herein, the scope of coverage of this patent is not limited thereto. On the contrary, this patent covers all embodiments of the teachings of the disclosure that fairly fall within the scope of permissible equivalents.

What is claimed is:

1. A water dispenser riser assembly system for use with a plurality of different water dispensers, comprising:

a standard core;

a plurality of top plates that are each designed to match one of the plurality of different water dispensers;

a plurality of front plates that are each designed to match one of the plurality of different water dispensers;

wherein the standard core is interchangeable between the plurality of top plates and the plurality of front plates;

wherein a water dispenser is selected from the plurality of different water dispensers;

wherein a top plate and a front plate are selected that are designed to match the selected water dispenser; and wherein the selected top plate and the selected front plate are attached to the standard core to configure a riser assembly specific for attachment to the selected water dispenser.

2. The water dispenser riser assembly for use with a water dispenser of claim 1, wherein the selected top plate includes cutouts and attachment points to match the base of the selected water dispenser.

3. The water dispenser riser assembly for use with a water dispenser of claim 1 wherein the selected front plate includes cutouts and attachment points to match the selected water dispenser.

4. The water dispenser riser assembly for use with a water dispenser of claim 1, wherein the standard core is 12 inches in width.

5. The water dispenser riser assembly for use with a water dispenser of claim 1, wherein the selected water dispenser has a dispensing nozzle and wherein when the riser assembly is connected to the selected water dispenser, the height of the dispensing nozzle is approximately slightly below the chest level of an average user.

* * * * *